US009016531B2

(12) United States Patent
Paugh et al.

(10) Patent No.: US 9,016,531 B2
(45) Date of Patent: Apr. 28, 2015

(54) RETRACTOR CARRYING CASE

(75) Inventors: Boake Paugh, Rancho Cucamonga, CA (US); Joshua R. Buesseler, Seattle, WA (US)

(73) Assignee: West Coast Mfg. Co., Ontario (CA)

( * ) Notice: Subject to any disclaimer, the term of this patent is extended or adjusted under 35 U.S.C. 154(b) by 523 days.

(21) Appl. No.: 13/340,505

(22) Filed: Dec. 29, 2011

(65) Prior Publication Data

US 2013/0168423 A1 Jul. 4, 2013

(51) Int. Cl.

| | |
|---|---|
| ***A45F 5/00*** | (2006.01) |
| ***A45C 1/04*** | (2006.01) |
| ***A45F 3/00*** | (2006.01) |
| ***A45F 5/02*** | (2006.01) |
| ***B65H 75/44*** | (2006.01) |
| ***B65H 75/48*** | (2006.01) |
| *A45C 11/00* | (2006.01) |

(52) U.S. Cl.

CPC ..... *B65H 75/446* (2013.01); *A45C 2011/002* (2013.01); *A45F 5/004* (2013.01); *A45F 5/021* (2013.01); *A45F 2005/025* (2013.01); *A45F 2005/026* (2013.01); *B65H 75/48* (2013.01)

(58) Field of Classification Search

CPC ..... A45F 5/00; A01K 89/00; B60R 22/34
USPC ..... 224/162, 269, 666, 668, 930
See application file for complete search history.

(56) References Cited

U.S. PATENT DOCUMENTS

| | | | | |
|---|---|---|---|---|
| 4,286,639 | A * | 9/1981 | Murphy | 206/37 |
| 4,692,034 | A * | 9/1987 | Fukui et al. | 374/208 |
| 5,149,203 | A | 9/1992 | Sacks | |
| 5,351,868 | A * | 10/1994 | Beletsky et al. | 224/245 |
| 6,542,757 | B2 * | 4/2003 | Bae | 455/575.2 |
| 6,966,519 | B2 * | 11/2005 | Salentine et al. | 242/379 |
| 7,354,304 | B2 * | 4/2008 | Livingston | 439/501 |
| 7,530,457 | B2 | 5/2009 | Tsang | |
| 7,665,684 | B2 * | 2/2010 | Salentine et al. | 242/379.2 |
| 8,220,676 | B1 * | 7/2012 | Hicks | 224/162 |
| 8,284,980 | B2 * | 10/2012 | Parker et al. | 381/384 |
| 8,333,310 | B2 * | 12/2012 | Tages | 224/197 |

(Continued)

OTHER PUBLICATIONS

International Search Report dated Jul. 5, 2012 for PCT/2012/033666 (4 pages).

(Continued)

*Primary Examiner* — Justin Larson
*Assistant Examiner* — Lester L Vanterpool
(74) *Attorney, Agent, or Firm* — Christie, Parker & Hale, LLP

(57) ABSTRACT

A retractor carrying device for personal use has multiple components that allow for easy storage, deployment, and detachment of small items carried inside the device. In one embodiment, the device includes a carrying case having an interior cavity, a retractor assembly having an interior portion and an exterior portion joined to the carrying case, and an attachment assembly connected to the exterior portion so that the device may be connected to a user's belt or strap. A retractable tensile member is rotatably disposed within the interior portion and is moveable between a fully retracted position and an extended position. The device also includes an end fitting connected to the retractable tensile member that is adapted to releasably attach the small portable items. When the retractable tensile member is in the fully retracted position, the end fitting is configured to nest in a recess formed in the interior portion.

20 Claims, 12 Drawing Sheets

(56) References Cited

U.S. PATENT DOCUMENTS

| | | | | |
|---|---|---|---|---|
| 8,600,461 | B2 * | 12/2013 | Kroupa | 455/575.6 |
| 8,631,980 | B2 * | 1/2014 | Youssefi-Shams et al. | 224/197 |
| 8,783,531 | B2 * | 7/2014 | Kroupa | 224/162 |
| 2002/0148078 | A1 | 10/2002 | Salentine et al. | |
| 2003/0019893 | A1 | 1/2003 | Decoteau | |
| 2003/0040285 | A1 | 2/2003 | Whitley | |
| 2003/0157973 | A1 * | 8/2003 | Yang | 455/569 |
| 2004/0035897 | A1 | 2/2004 | Salentine et al. | |
| 2004/0180631 | A1 | 9/2004 | Lim et al. | |
| 2005/0011982 | A1 * | 1/2005 | Salentine et al. | 242/379.2 |
| 2005/0255898 | A1 * | 11/2005 | Huang | 455/575.8 |
| 2006/0054729 | A1 | 3/2006 | Salentine et al. | |
| 2006/0287006 | A1 * | 12/2006 | McIntyre et al. | 455/569.1 |
| 2007/0235492 | A1 * | 10/2007 | Sirichai et al. | 224/930 |
| 2008/0080732 | A1 * | 4/2008 | Sneed | 381/374 |
| 2009/0008419 | A1 | 1/2009 | Tsang et al. | |
| 2009/0084697 | A1 | 4/2009 | Gross | |
| 2010/0224519 | A1 * | 9/2010 | Kao | 206/320 |
| 2011/0009164 | A1 | 1/2011 | Amiri | |
| 2011/0130174 | A1 * | 6/2011 | Kroupa | 455/569.1 |

OTHER PUBLICATIONS

Written Opinion of the International Searching Authority dated Jul. 5, 2012 for PCT/2012/033666 (6 pages).

* cited by examiner

RETRACTOR CARRYING CASE

TECHNICAL FIELD

This application relates generally to carrying cases, and more particularly, to a carrying case with a tether.

BACKGROUND OF THE INVENTION

Cases for carrying and storing small items are known, especially those for personal use in carrying small portable items such as cell phones, cameras, and small tools. Typically, such items are secured inside the case only by sidewalls and a cover. However, because the items are not secured to the case once they are removed from the interior of the case, they are susceptible to being dropped and damaged.

Moreover, apparatuses for retractably tethering small items to a user are also known. Such apparatuses include a tether wound on a retractable reel where such reel is contained in a housing that can be clipped to the wearer's belt or waistband. However, while such apparatuses secure the small items to the wearer, they do not provide the protection associated with a carrying case.

Accordingly, it is desirable that a carrying case apparatus include an integrated retractor having a retractable tensile member that tethers small electronic devices or tools to an interior portion of the carrying case. Moreover, it is desirable that the integrated carrying case have a minimum profile thickness for convenience and ease. Furthermore, it is desirable to prevent, or at least minimize, contact between the retractable tensile member and the carrying case in order to prevent the carrying case from prematurely wearing down.

SUMMARY OF THE INVENTION

The present invention is directed to a retractor carrying device for personal use having multiple components that allow for easy storage, deployment, and detachment of small items carried inside the device. In one embodiment, the device includes a carrying case having an interior cavity, a retractor assembly having an interior portion and an exterior portion joined through an opening in the carrying case, and an attachment assembly connected to the exterior portion so that the device may be connected to a user's belt or strap. In accordance with a feature of the present invention, a retractable tensile member having a proximal end and a distal end opposite the proximal end is rotatably disposed within a circular flange formed on the interior portion and is moveable between a fully retracted position and an extended position. The device also includes an end fitting that is adapted to releasably attach the small portable items and is connected to the distal end of the retractable tensile member. The device also includes a recess formation located in the interior portion of the retractor assembly such that the end fitting is nested and tucked away in the recess formation when the retractable tensile member is in the fully retracted position.

In a more detailed embodiment, a lid is hingedly connected to the carrying case and is moveable between an open position and a closed position. Also in a more detailed embodiment, the lid is securable in the closed position by wrapping a looped strap connected to the lid around a clasp connected to a wall of the carrying case. In a further detailed embodiment, the end fitting includes a slit configured to receive a wrist strap connected to the small items with a press fit connection. Moreover, in one detailed embodiment, the terminal end of the retractable tensile member is connected to the end fitting by a knot formed in the terminal end of the retractable tensile member engaging a coaxial hole formed in the end fitting.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1A:
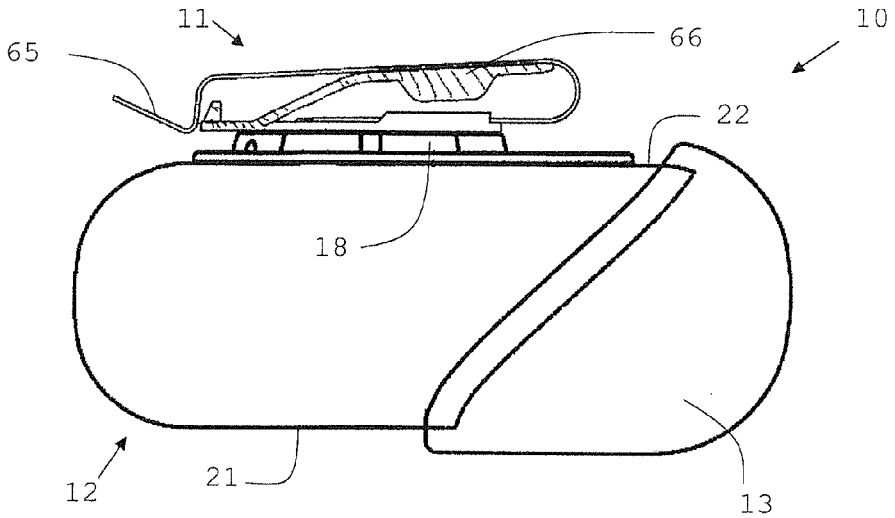
FIGS. 1A and 1B are a side view and a back view of an embodiment of a retractor carrying case, respectively.

The present invention relates to carrying cases with integrated retractors that can be carried on a person's body, in particular, retractors adapted for tethering small items, such as tools, gear, small electronic devices, badges and the like to the interior of the carrying case.

In an embodiment of the present invention as shown in FIGS. 1A, 1B, 2A, and 2B, a retractor carrying device 10 having a carrying case 12 and an integrated retractor assembly 11 is provided for carrying and/or storing small personal item(s). The carrying case 12 can be made of any suitable material, for example, thermoformed or vacuum formed from a closed cell polyethylene foam that provides a generally rigid housing structure. A nylon fabric (not shown) is bonded to the polyethylene foam to form an exterior of the carrying case 12 by any suitable means, such as a heated press process, in order to add strength, durability, and resiliency to the carrying case 12. In the disclosed embodiment, the carrying case 12 has a generally rectangular cross section formed from wall portions, including a front wall 21, a back wall 22 and two side walls 23, 24, defining an interior cavity 14 (FIG. 2A) for carrying and/or storing the small personal item(s).

The carrying case also includes a lid 13, formed with the same material and by the same process as the carrying case 12. The lid 13 is hingedly mounted to the back wall 22 of the carrying case 12 to retain the small personal item(s) in the interior cavity 14 of the carrying case 12. The lid 13 is moveable between an open position (FIG. 2A) and a closed position (FIG. 2B) and is secured in the closed position by any suitable means, for example, a looped strap 15 that is attached to the lid 13 and adapted to be wrapped around a clasp 16 located on an exterior surface of the front wall 21 of the carrying case 12. In another embodiment, the lid 13 is securable in the closed position by a hook and loop type fastener fastening the lid 13 to the carrying case 12. In the disclosed embodiment, the lid 13 is hingedly secured to the carrying case 12 by a hinge portion 124 extending from a back end of the lid 13 and mounted onto the back wall 22 of the carrying case 12. Two holes 125, 126 in the hinge portion 124 are configured to align with two holes 127, 128 in the back wall 22 of the carrying case 12. Two fasteners 142 and 143, such as button head rivets, extend through the holes 125, 126, 127, and 128 to hingedly attach the lid 13 to the carrying case 12. It is understood that the lid 13 may be integral with the carrying case 12 and be an extension of the carrying case 12 as opposed to an attached portion. The carrying case 12 and the lid 13 advantageously protect the small item(s) stored in the interior cavity 14 of the carrying case 12 against exposure to elements of the environment and other possible damage.

Figure 3A:
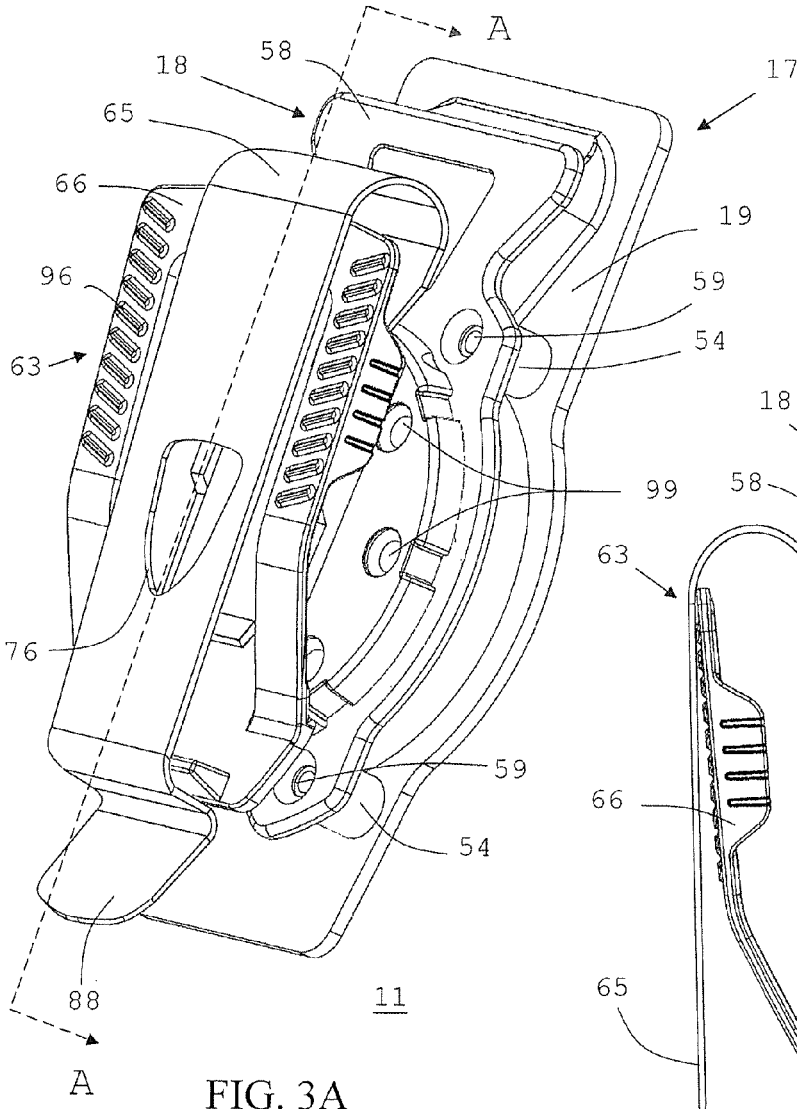
FIGS. 3A and 3B are a perspective and side view of an embodiment of the retractor assembly, respectively.
Figure 3B:
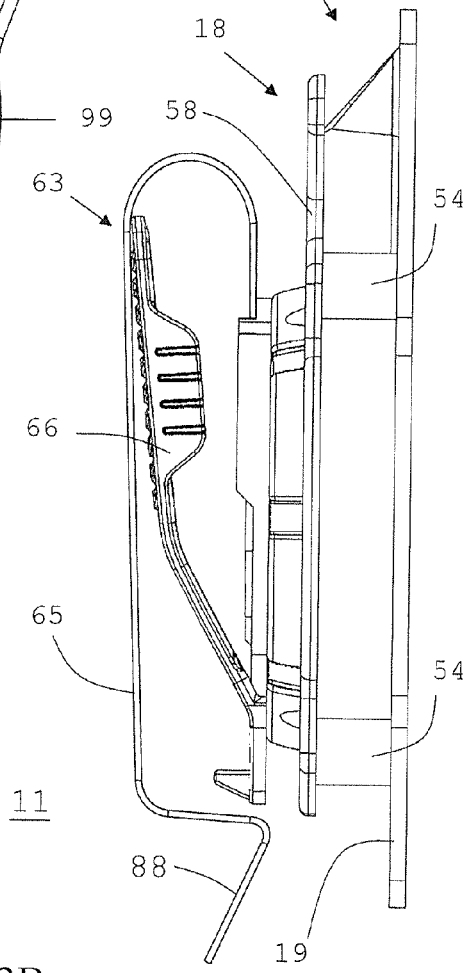
Figure 3C:
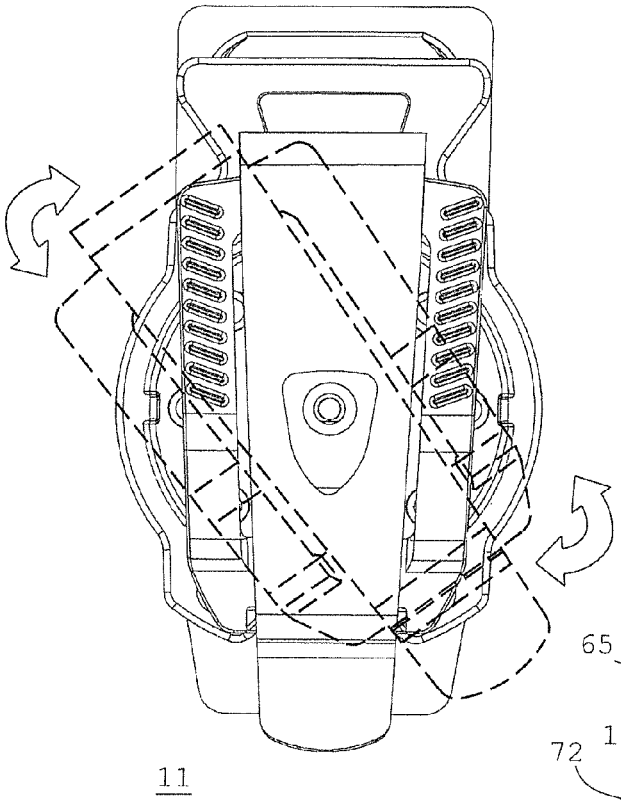
FIG. 3C is a front view of an embodiment of the retractor assembly showing the ratcheting capability of the clip assembly in broken lines.
Figure 3D:
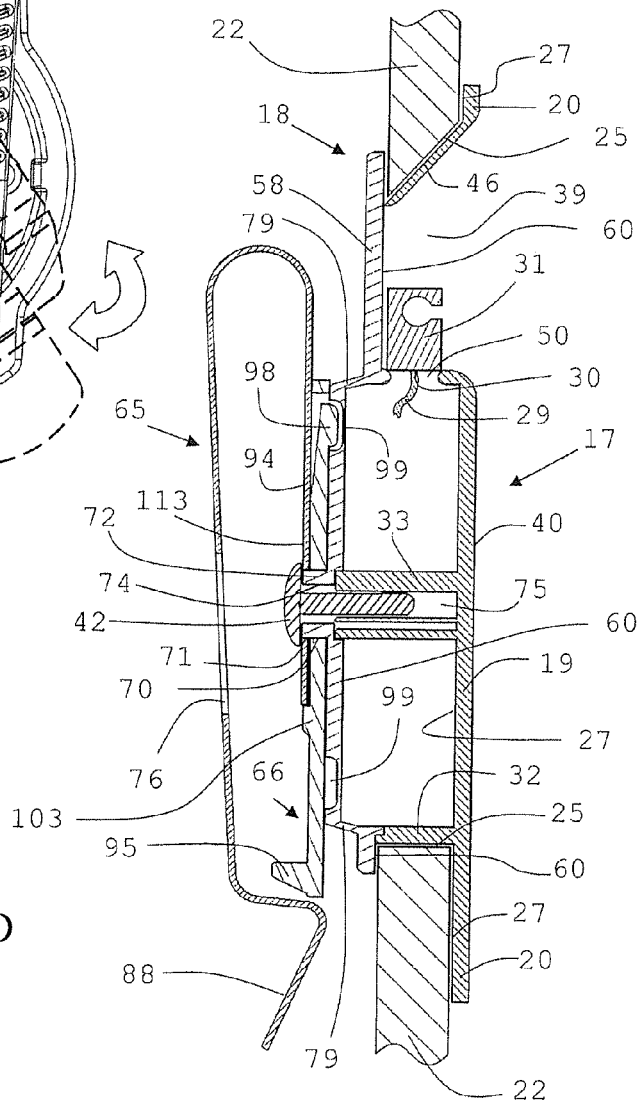
FIG. 3D is a cross-sectional view of an embodiment of the retractor assembly and the carrying case taken along line A-A.

As shown in FIGS. 3A, 3B, and 3D, the integrated retractor assembly 11 includes an interior portion 17, an exterior portion 18, an attachment assembly 63 mounted on the exterior portion 18, and a retractable reel mechanism 55 (FIGS. 4A and 4D) housed between the exterior portion 18 and the interior portion 17. The interior portion 17 and the exterior portion 18 are configured differently but each has a panel 19 and 58, respectively, that is fastened to each other across a die cut opening 25 (FIG. 3D) formed in the back wall 22 of the carrying case 12. Accordingly, the exterior portion 18 is mounted outside of the back wall 22 of the carrying case 12 and the interior portion 17 is mounted in the interior cavity 14 of the carrying case 12. In that regard, the interior panel 19 is larger and spans a greater area than the exterior panel 58 to provide better load distribution around the opening 25 of the carrying case 12 against the weight of the item carried inside the carrying case 12.

Figure 4A:
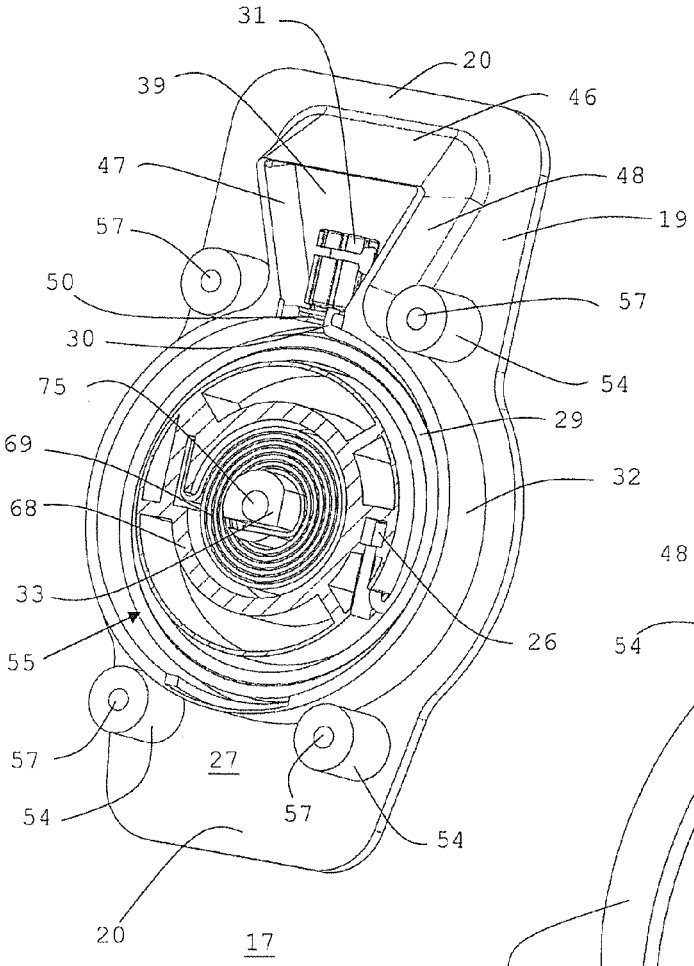
FIGS. 4A, 4B, 4C, and 4D are a front perspective, a back perspective, a side, and a front view of an embodiment of the interior portion, the retractable reel mechanism, and the end fitting, respectively.

As illustrated in the embodiment of FIG. 4A, a back surface 27 of the interior panel 19 is formed with a plurality of internally threaded spacers 54 protruding perpendicularly from a peripheral region 20 of the back surface 27. The peripheral region 20 is generally delineated by a circular flange 32 projecting from the back surface 27. The circular flange 32 houses the retractable reel mechanism 55, as explained further below. The internally threaded spacers 54 have a cylindrical body with a coaxial threaded bore 57 adapted to receive a fastener (not shown). In another embodiment, the bore 57 may comprise a smooth bore that is adapted to receive a self-threading fastener (not shown).

Figure 6A:
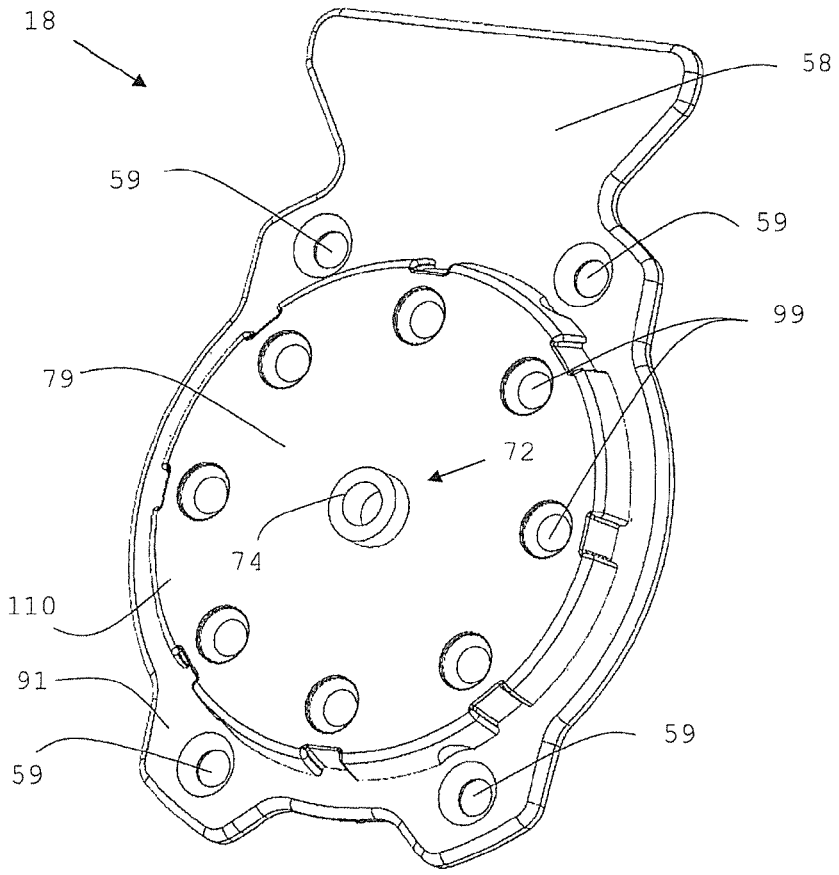
FIGS. 6A and 6B are a perspective view and a side view of an embodiment of the exterior portion, respectively.
Figure 6B:
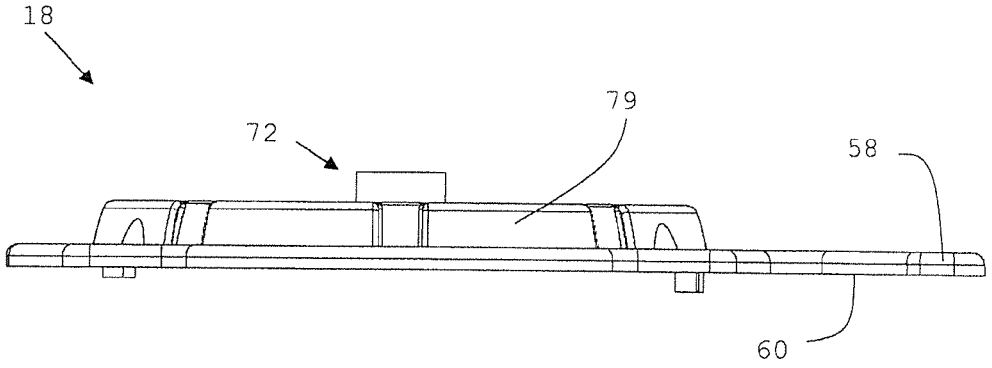

Correspondingly, with reference to the embodiment of FIG. 6A, a front surface 60 of the exterior panel 58 is formed with a common plurality of countersunk holes 59 in a peripheral region 91 of the front surface 60. The countersunk holes 59 correspond with the spacers 54 so that fasteners can be inserted through the holes 59 and into the bores 57 to fasten the interior and exterior portions 17, 18 together. In that regard, the spacers 54 extend through die-cut apertures (not shown) formed in the back wall 22 of the carrying case 12, where the spacers 54 have a height that is substantially equal to a thickness of the back wall 22.

Figure 4B:
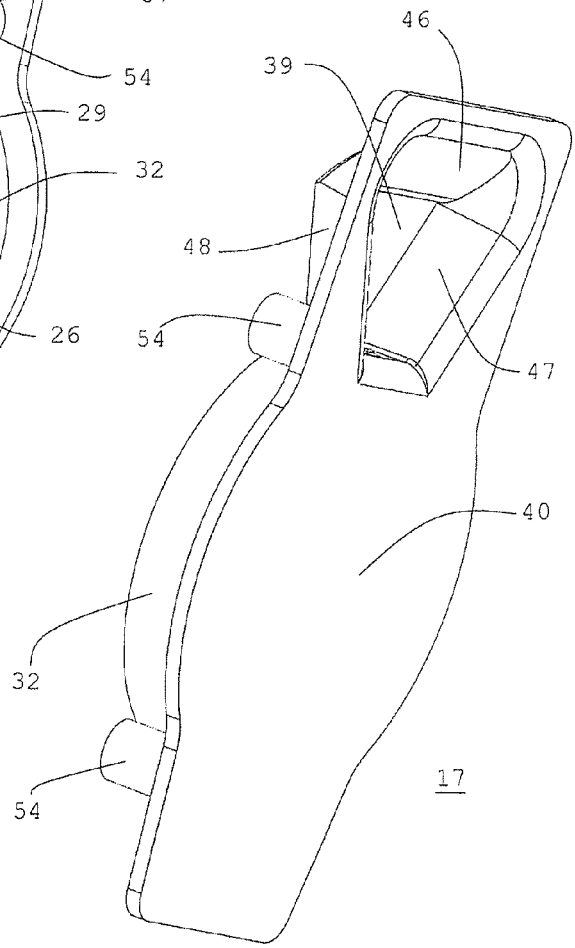

In the disclosed embodiment, the interior panel 19 has a generally elongated shape. The circular flange 32 occupies a mid-section of the interior panel 19. When the interior panel 19 and the exterior panel 58 are joined, the circular flange 32 sits within the die-cut opening 25, as illustrated in FIG. 3D. When the interior panel 19 and the exterior panel 58 are fastened together, the circular flange 32 and the front surface 60 of the exterior panel 18 enclose the reel mechanism 55 except for a small aperture 50 formed at the top of the circular flange 32 which opens into a recess formation 39 (FIG. 4B) accessible from the front side of the interior panel 19.

The die-cut opening 25 is configured to substantially match the size and shape of the circular flange 32 and the recess formation 39 so that the peripheral regions 20, 91 of the interior and exterior panel 19, 58, respectively, brace against the back wall 22 of the carrying case 12 from outside and inside, respectively, to integrate the retractor assembly 11 and the carrying case 12. As such, the periphery regions 20, 91 engage the back wall 22 of the carrying case 12 in order to prevent the retractor assembly 11 from completely passing through the die cut opening 25. Moreover, mounting the interior portion 17 within the die cut opening 25 advantageously reduces the overall profile thickness of the retractor assembly 11. It is understood that the interior portion 17 and the exterior portion 18 may be formed as a single integrated member.

Figure 4D:
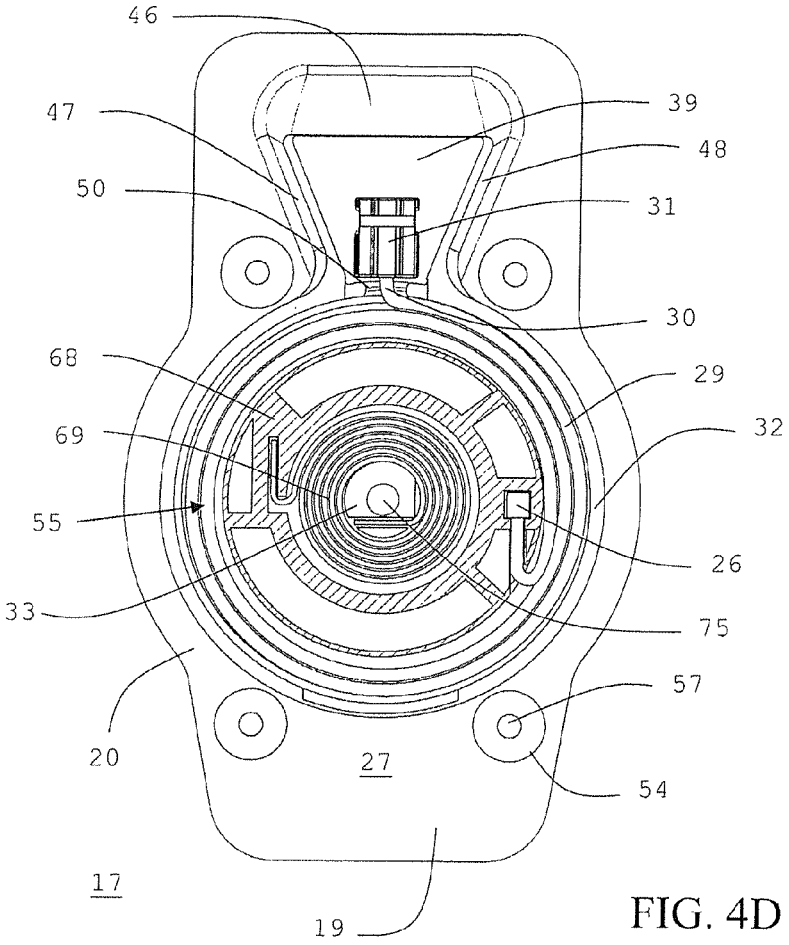
Figure 4C:
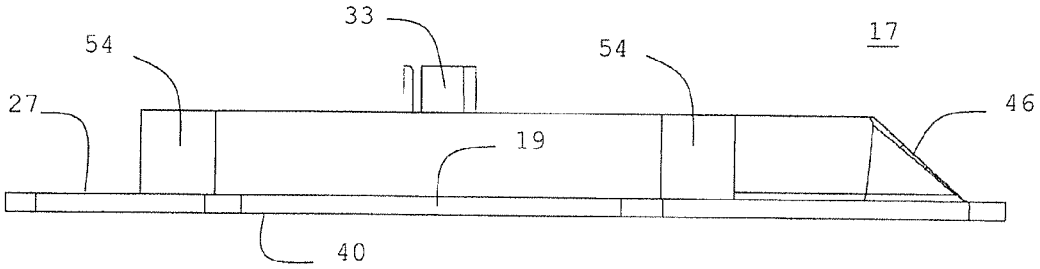

In reference to FIGS. 4A and 4D, the retractable reel mechanism 55 includes a reel 68, a spring 69, such as a flat coil clock spring or a constant tension flat coil spring, a retractable tensile member 29 having a distal end 30 and a proximal end 26, and an end fitting 31. The distal end 30 of the retractable tensile member 29 is connected to the end fitting 31 and the proximal end of the retractable tensile member 29 is connected to the reel 68 which is rotatably mounted on a central axis member 33 projecting from the back surface 27 of the interior panel 19. The reel 68 is biased by the coil spring 69 for rotation to wind or retract the retractable tensile member 29 onto the reel 68. A suitable retractable reel mechanism 55 is described in U.S. Patent Publication No. 2011-0174852-A1, which is hereby incorporated by reference in its entirety. The retractable tensile member 29 is adapted to unwind from the reel 68 and extend outside of the circular flange 32 through the aperture 50 when the distal end 30 of the retractable tensile member 29 is pulled with a sufficient force to overcome the biasing retraction force of the coil spring 69. When the distal end 30 is released, the retractable tensile member 29 rewinds into a fully retracted position on the reel 68 under the force of the coil spring 69. In that regard, the end fitting 31 is received in the recess formation 39 of the interior panel 19 where the end fitting 31 is nested and tucked away in the recess formation 39. Best seen in FIGS. 4A and 4B, the recess formation 39 has a funnel shape with a wider upper portion that tapers to a narrower lower portion, which funnel shape helps "feed" the end fitting 31 toward the aperture 50 when the tensile member 29 is being retracted. Two sidewalls 47, 48 extend at a generally perpendicular angle from the back surface 27 of the interior panel 19 whereas an upper side wall 46 extends at an incline of about forty-five degrees to facilitate the ingress and egress of the end fitting 31 in the recess formation 39.

Figure 2B:
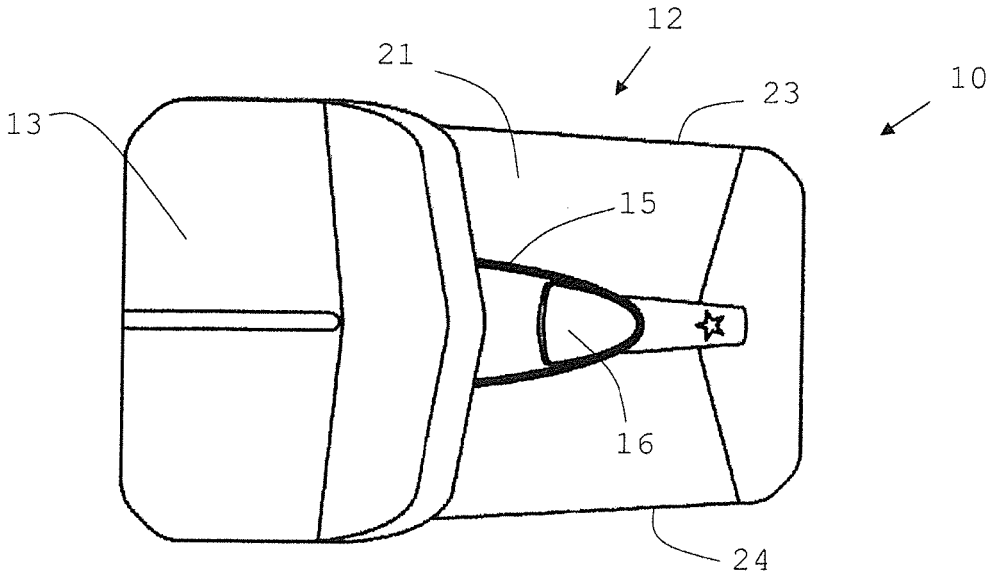
FIG. 2B is a front view of an embodiment of the retractor carrying case shown with the lid in a closed position.
Figure 2A:
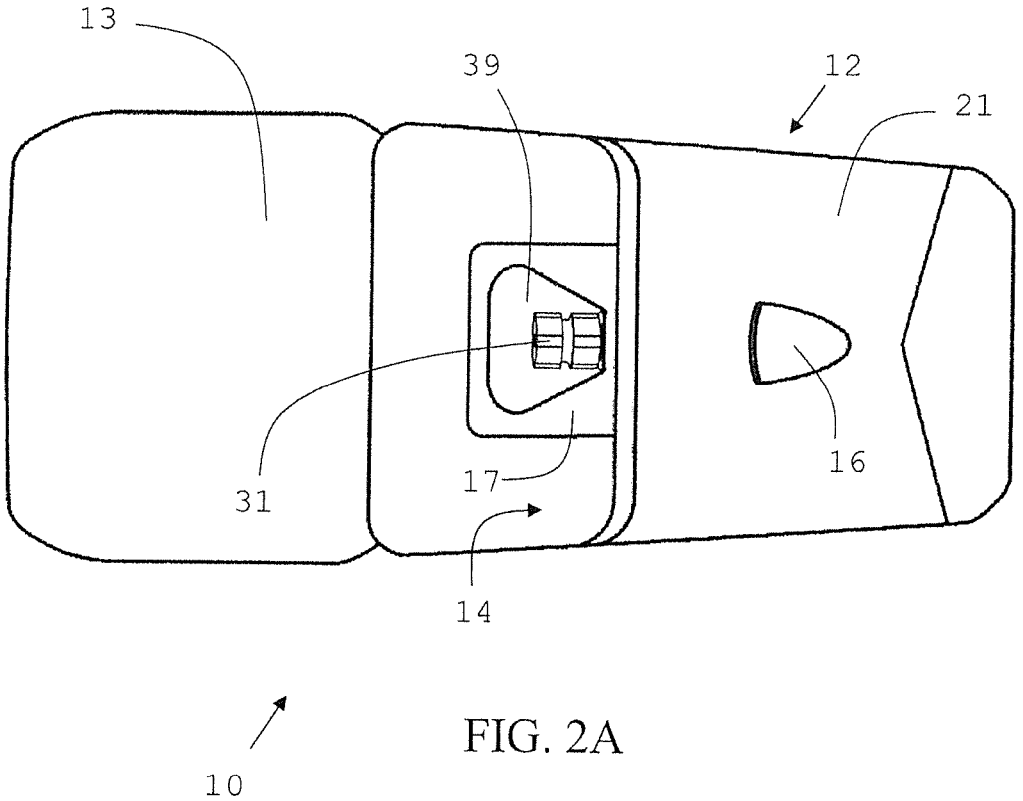
FIG. 2A is a front view of an embodiment of the retractor carrying case shown with the lid in an open position.

The retractable tensile member 29 can be made of any suitable material, for example, chain, Kevlar cord, cable, or monofilament, that provides sufficient strength to tether a small electronic device or tool and sufficient flexibility to wind on the reel 68. As depicted in FIGS. 2A and 3D, by providing the aperture 50 through the circular flange 32 and the recess formation 39 on the back surface 27 of the interior panel 19, the tensile member 29 is conveniently dispensed from the interior cavity 14 of the carrying case 12, which feature avoids the tensile member 29 becoming otherwise tangled on the outside of the carrying case 12 and ensures that the item tethered is retracted into the interior cavity 14 of the carrying case 12.

Figure 5A:
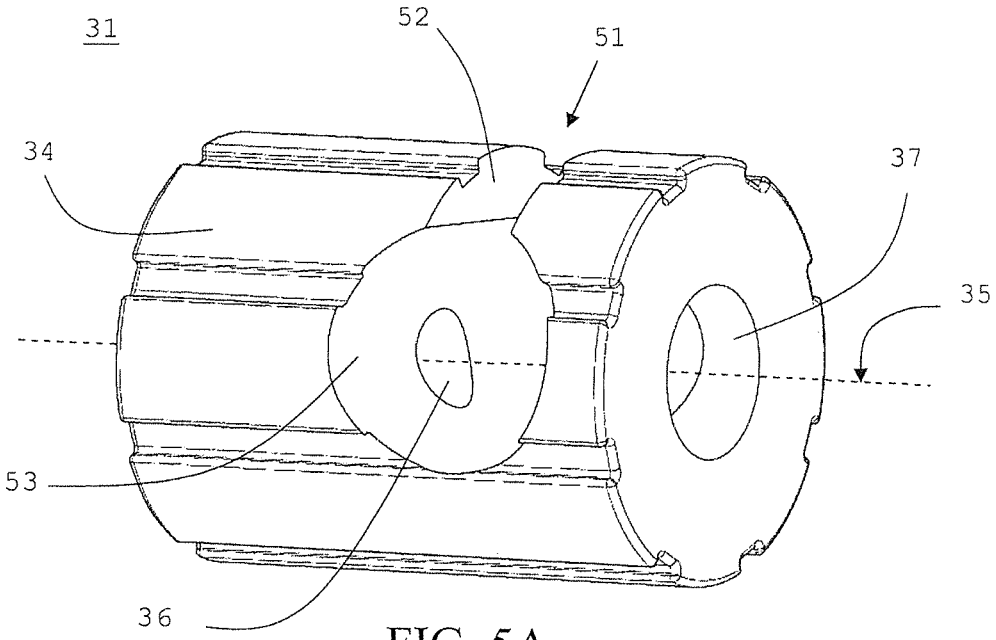
FIG. 5A is a perspective view of an embodiment of the end connector.
Figure 5B:
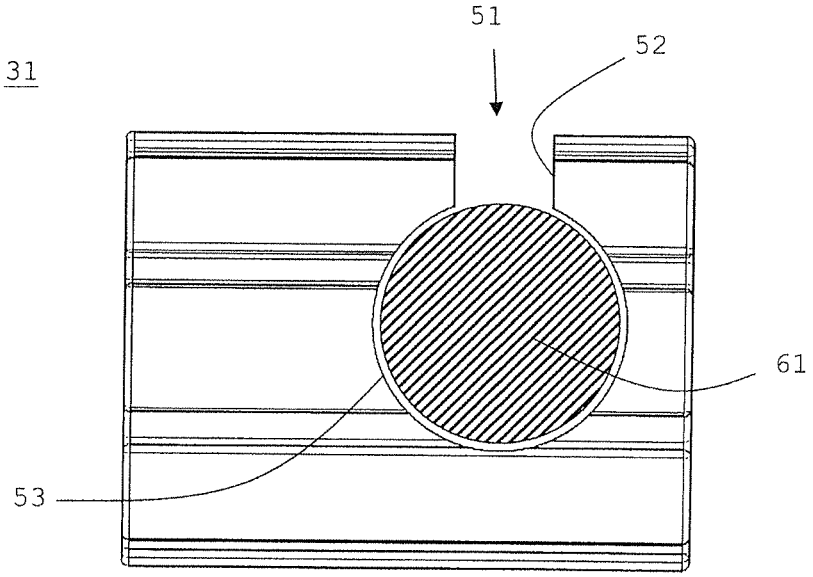
FIG. 5B is a side view of an embodiment of the end connector and the wrist strap.

Referring now to FIGS. 5A and 5B, the end fitting 31 on the distal end 30 of the tensile member 29 has an generally cylindrical body 34 defining a longitudinal axis 35 and two through-holes 36, 37. The holes 36, 37 are in alignment with each other and coaxial with the longitudinal axis 35 but are separated by a semi-circumferential slit 51 forming a gap space between the larger hole 37 and the smaller hole 36, the significance of which is explained further below. Both holes 36, 37 have a diameter that at least allows passage of the tensile member 29, however hole 37 has a larger diameter relative to the hole 36 which allows passage of a knot (not shown) formed on the distal end 30 of the tensile member 29. In one embodiment, the distal end 30 of the tensile member 29 may be secured to the end fitting 31 by inserting the tensile member 29 through the smaller hole 36 and then the larger hole 37, tying a knot in the distal end 30, and retracting the tensile member 29 until the knot passes through the larger hole 37 and engages the smaller hole 36. In an alternative embodiment, the distal end 30 of the tensile member 29 may be secured to the end fitting 31 by means of an adhesive, such as polyepoxide.

Referring again to FIG. 3D, the end fitting 31 is sized larger than the aperture 50 but smaller than the recessed formation 39 so that when the tensile member 29 is in the fully retracted position, the end fitting 31 is retained and fully recessed in the recess formation 39 such that the end fitting 31 does not protrude into the interior cavity 14 of the carrying case 12. This feature thus advantageously permits the small electronic device or tool housed in the interior cavity 14 of the carrying case 12 to rest and lie flush against a front surface 40 of the interior panel 19. Moreover, the recess formation 39 is configured to minimize, if not prevent, contact between the tensile member 29 and the carrying case 12 when the tensile member 29 is moved between the fully retracted position and an extended position, which contact would otherwise prematurely wear the carrying case 12.

As shown in FIGS. 5A and 5B, the end fitting 31 provides a means of connecting the distal end 30 of the tensile member 29 to an object, such as a small electronic item or a tool, stored in the interior cavity 14 of the carrying case 12. A wrist strap 61, such as a tubular bungee wrist cord typically found on a camera, personal data assistant or other small electronic device, may be releasably attached to the end fitting 31 by inserting the wrist strap 61 into the slit 51 in the end fitting 31. The slit 51 has a narrower radial portion 52 leading to a wider circular center portion 53. As a safety feature, the slit 51 is configured to require that the strap 61 be press fit through the narrower portion 52 and into the circular center portion 53 of the slit 51. This press fit connection supplies a frictional force which must be overcome to detach the strap from the end fitting 31 and which thereby prevents the strap from inadvertently disengaging the end fitting 31. In an alternative embodiment, a tubular bungee strap or any other suitable attachment means may be provided to tether devices which are not equipped with a strap.

Figure 7A:
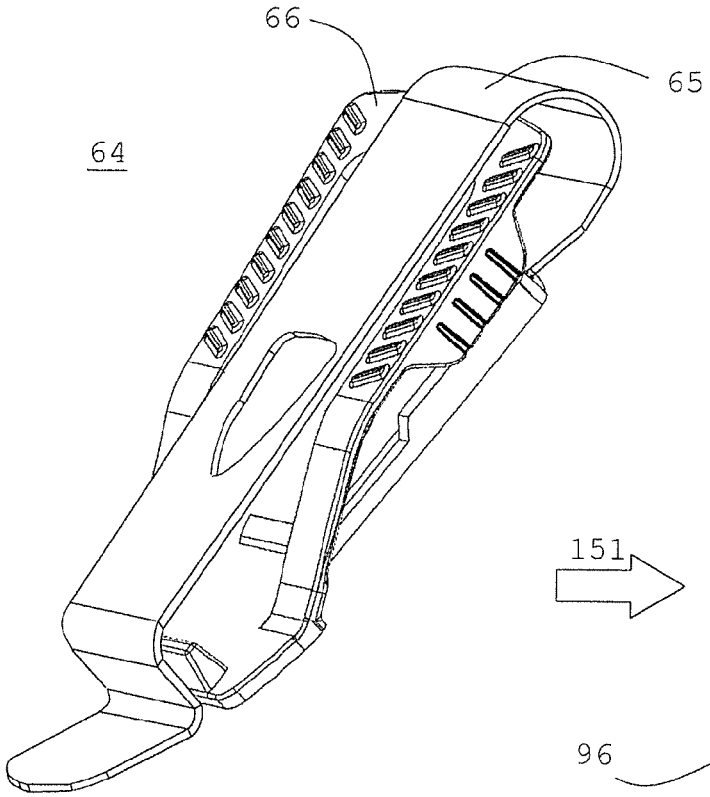
FIGS. 7A and 7B are a perspective view and side view of an embodiment of the clip assembly, respectively.
Figure 7B:
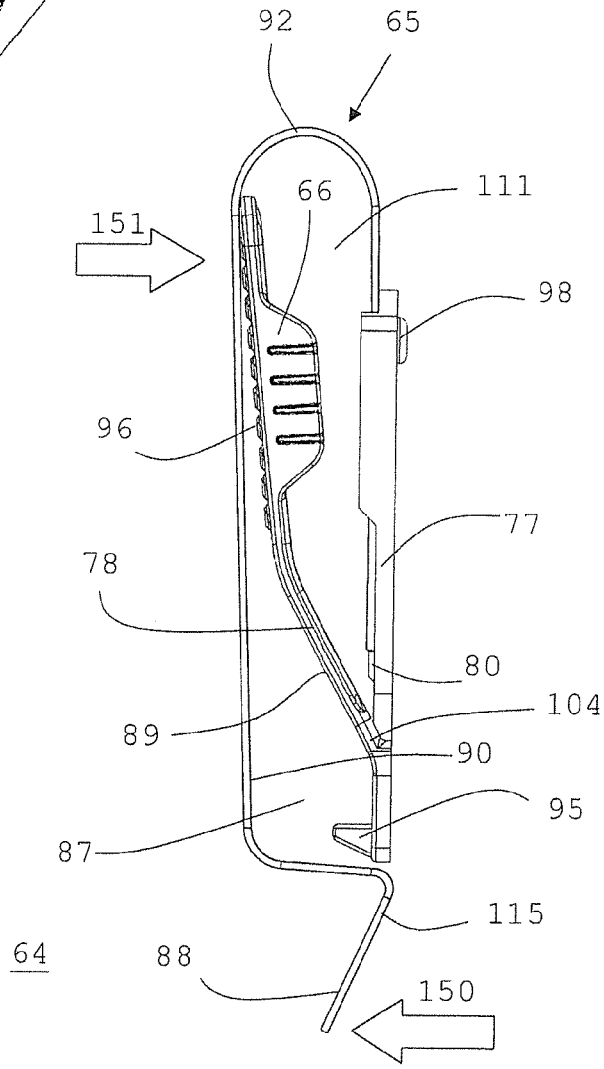
Figure 8:
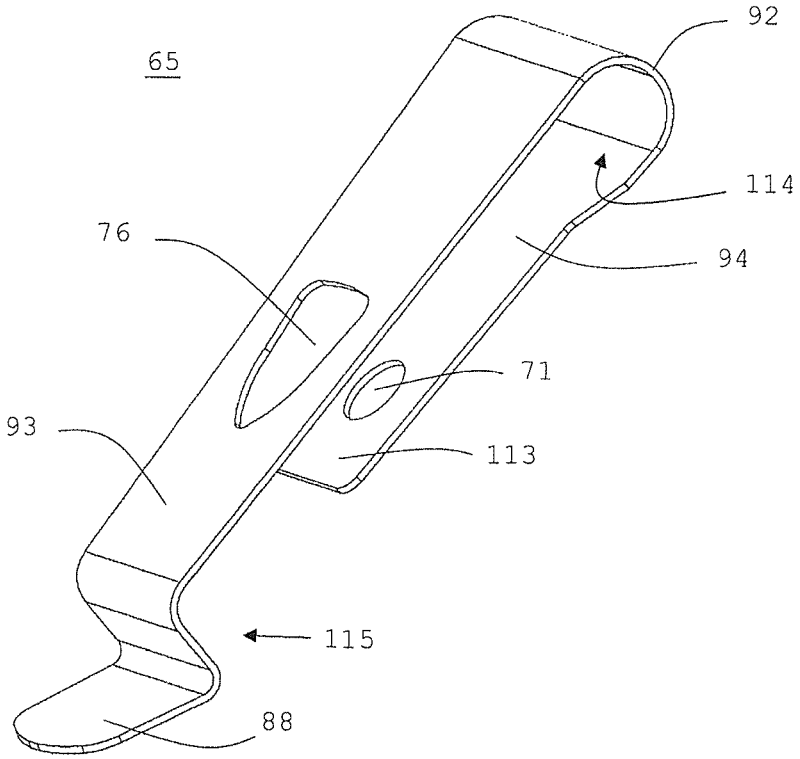
FIG. 8 is a perspective view of an embodiment of the clip.

In one embodiment, the attachment assembly 63 includes the externally mounted clip assembly 64, as illustrated in FIGS. 7A and 7B. The clip assembly 64 comprises an outer clip member 65 and an underlapping strap retainer 66, which are provided to attach the retractor carrying case 10 to the user's belt, strap, or waistband. As illustrated in FIG. 8, the outer clip member 65 has a U-shaped cross-section having a U-bend 92, a longer outer leg 93 and a shorter inner leg 94 defining a downwardly facing gap 114 in between. The outer clip member 65 can be formed from a sheet material die cut and folded onto itself to provide the U-shaped cross-section. The outer leg 93 has an "S-bend" end 115 forming an angled catch 88 that extends below the strap retainer 66.

Figure 9A:
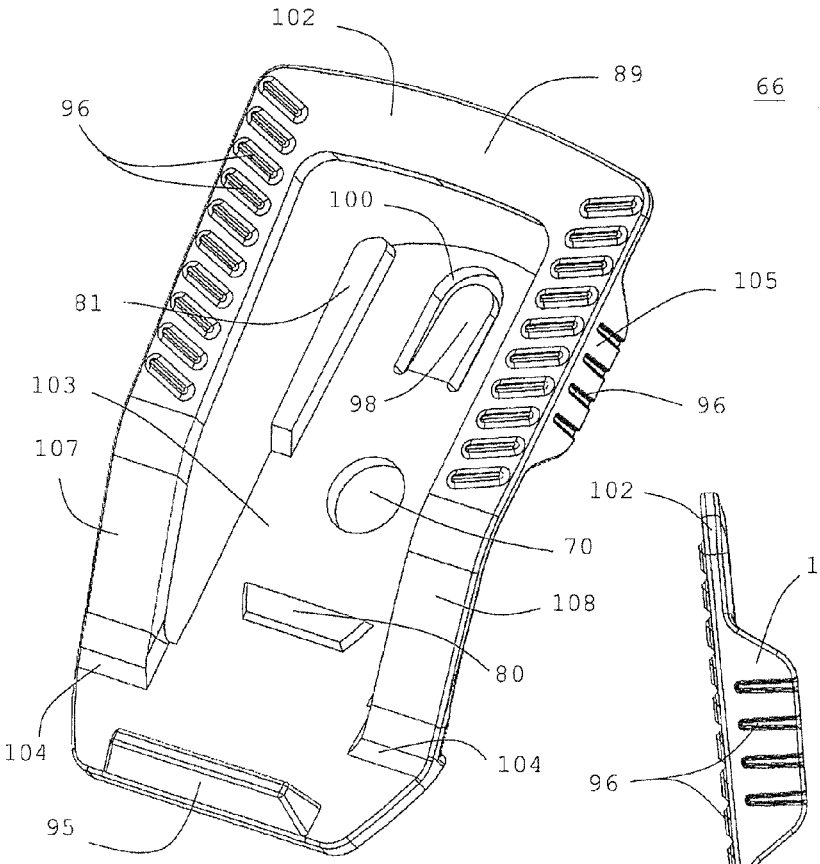
FIGS. 9A and 9B are a perspective view and a side view of an embodiment of the clip retainer, respectively.
Figure 9B:
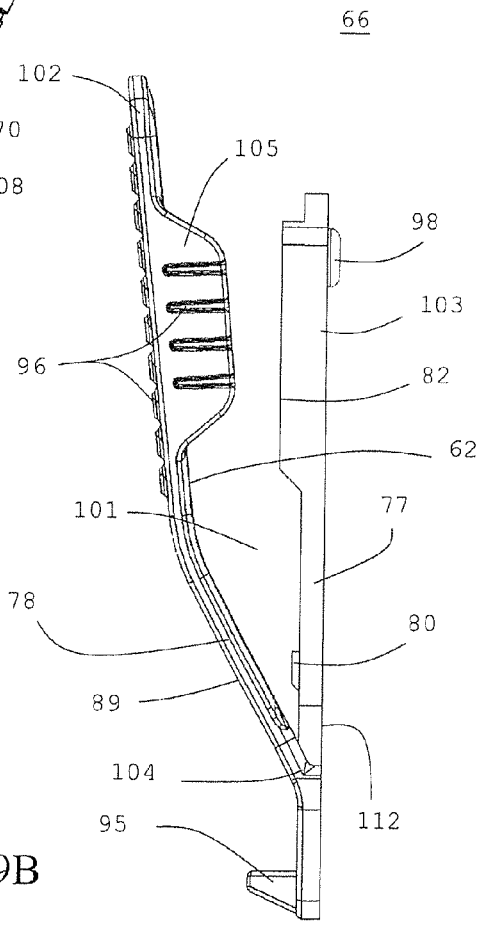

As shown in FIG. 9B, the strap retainer 66 has a wishbone side profile with an outer portion 78 and an inner portion 77 that diverge from each other to form an upwardly-facing gap 101 in between. In the disclosed embodiment, the outer portion 78 has an outer peripheral prong 102 and the inner portion 77 an inner tongue 103. The prong 102 and the tongue 103 diverge from each other at a junction 104 to form the upwardly-facing gap 101. The strap retainer 66 can be formed from a sheet material that is die-cut and shaped to form the peripheral prong 102 and the tongue 103. Alternatively, the strap retainer 66 could be molded from a suitable material, such as Nylon. The peripheral prong 102 has two side tabs 105 on opposite sides of the peripheral prong 102 that extend perpendicularly from a front surface 62 of the peripheral prong 102. The tongue 103 is formed with two side bumpers 81, 82 and a bottom bumper 80 that are adapted to engage and retain the shorter leg 94 (FIG. 8) of the outer clip member 65 in alignment with the strap retainer 66. A lip 95 is provided at or near a bottom edge of the strap retainer 66, the purpose of which will be described in detail below. Moreover, friction-inducing formations 96 are provided on a back surface 89 of the peripheral prong 102 and on an outer surface of the side tabs 105.

In assembling the clip assembly 64, the shorter leg 94 of the outer clip member 65 is inserted into the upwardly-facing gap 101 of the strap retainer 66 such that the outer clip member 65 and the strap retainer 66 are interfacing each other and the outer peripheral prong 102 sits in between the shorter and longer legs 94, 93 of the clip member 65. The shorter leg 94 is nested between the bottom and side bumpers 80, 81, 82 of the strap retainer 66. The longer leg 93 of the clip member 65 is narrower than the width of the peripheral prong 102 such that two sides 107, 108 of the peripheral prong 102 are exposed and not obstructed by the longer leg 93.

For mounting the clip assembly 64 to the carrying case 12, the front surface 60 of the exterior panel 58, as illustrated in the embodiment of FIG. 6A, is formed with a cylindrical protrusion 72 having a threaded bore 74 for receiving a fastener, such as a button head screw. The front surface 60 is also formed with a raised circular surface 79 concentric about the cylindrical protrusion 72. Along a peripheral portion 110 of the raised circular surface 79 are a plurality of small depressions 99 diametrical and equally-spaced around the peripheral portion 110, the significance of which is explained further below. In the disclosed embodiment, there are eight depressions 99.

As for the clip assembly 64, holes 76 and 71 (FIG. 8) are provided in the outer leg 93 and the inner leg 94 of the clip member 65, respectively, and hole 70 (FIG. 9A) is provided in the tongue 103 of the strap retainer 66. These holes 76, 71, and 70 are aligned with each other when the clip assembly 64 is assembled in the manner described above so that the fastener 42 can be inserted through the holes 76, 71, and 70 and into the threaded bore 74 (FIG. 6A) in the cylindrical protrusion 72 and the threaded bore 75 (FIG. 3D) in the central axis member 33. In another embodiment, the bores 74 and 75 may comprise smooth bores that are adapted to receive a self-threading fastener. As shown in FIG. 3D, when installed properly, the tongue 103 rests against the raised circular surface 79 of the exterior panel 58 with the fastener 42 secured to the carrying case 12 via the hole 71 in the shorter leg 94 and the hole 70 in the tongue 103. Moreover, the height of the cylindrical protrusion 72 is substantially equal to the combined thickness of the exterior panel 58 and the shorter leg 94 such that the fastener 42 rests flush against a back surface 113 of the shorter leg 94, as illustrated in FIG. 3D. The hole 76 in the longer leg 93 advantageously facilitates installation of the fastener 42 with either hand tools or power tools.

The clip assembly 64 defines a generally serpentine path as illustrated in FIG. 7B, starting at the S-bend end 115 of the clip member 65 to an upper end of the peripheral prong 102 and then down toward the junction 104 of the prongs 107, 108. Two cavities are defined: a cavity 87 at the start of the serpentine path near the catch 88, and a cavity 111 between the U-bend 92 of the clip member 65 and the junction 104 of the peripheral prong 102. It is understood that the retractor carrying device 10 can be either hooked onto a belt or strap already worn on a person or be placed on a belt or strap before the latter is donned. In the latter instance, the belt or strap can be simply threaded through the cavity 87 formed between the longer leg 93 of the clip member 65 and the exterior portion 78 of the strap retainer 66. In the former instance, the clip member 65 is adapted to be elastically deformed away from the strap retainer 66. As shown in FIG. 7B, the user may elastically press (arrow 150) the catch 88 away from the outer portion 78 of the strap retainer 66 thus expanding the cavity 87 in order to permit the user to insert the belt into the cavity 87. With the cavity 87 expanded, the belt can drop over the lip 95 and enter the cavity 87 which movements secure the retractor carrying device 10 onto the belt. When the belt is inserted into the cavity 87, the user may release the catch 88 and thus permit the cavity 87 to return to its original neutral state. After the user's belt or strap has been inserted into the cavity 87, the user applies a downwardly force on the retractor carrying device 10 to advance the belt toward the U-bend 92 of the outer clip member 65 along the back surface 89 of the exterior portion 78 of the strap retainer 66. As further illustrated in FIG. 7B, the force (arrow 151) supplied by advancing the belt along the back surface 89 causes the exterior portion 78 of the strap retainer 66 to elastically deform towards the interior portion 77, thus contracting the cavity 111. The restorative force supplied by the elastically deformed strap retainer 66 then causes the user's belt or strap to deform around the clip 65. Accordingly, when inserted into the clip assembly 64, the user's belt or strap serpentines between the clip 65 and the strap retainer 66 such that the belt or strap is in contact with the back surface 89 of the strap retainer 66 and an interior surface 90 of the clip 65. To remove the retractor carrying device 10 from the belt, the aforementioned movements are performed in reverse.

As best shown in FIG. 7B, the lip 95 prevents the user's belt or strap from inadvertently disengaging the clip assembly 64. As a further safety feature, the friction-inducing formations 96, e.g., ridges, formed on the back surface 89 of the strap retainer 66 engage the user's belt or strap. In an alternative embodiment, the back surface 89 of the strap retainer 66 may contain surface features (not shown) instead of, or in addition to, the friction-inducing formations 96, such as a knurled surface, etching, or a coating.

The outer clip member 65 and the strap retainer 66 are made of a suitably rigid but flexible material. In one embodiment of the invention, the strap retainer 66 is molded from acetal plastic and the clip 65 is formed from stainless steel. However, the strap retainer 66 and the clip 65 may be formed from any material that provides sufficient strength and flexibility, such as nitinol, aluminum alloy, PVC, or carbon fiber-reinforced plastic, without departing from the scope of the present invention.

As shown in FIG. 3C, the clip assembly 64 is configured to assume different angular positions relative to the carrying case 12. In the disclosed embodiment, the clip assembly 64 can ratchet into multiple different angular positions about the central axis member 33 or the fastener 42. In order to facilitate ratcheting of the clip assembly 64, the strap retainer 66 contains a pawl 98 (FIG. 3D) formed on a front surface 112 of the strap retainer 66 that is adapted to engage any of recesses 99 radially disposed on the circular raised portion 79 of the exterior panel 58. As mentioned above, the disclosed embodiment provides eight different positions that are angled apart by forty-five degrees. As shown in the embodiment of FIGS. 9A and 9B, the pawl 98 is formed by a U-shaped cutout 100 in the strap retainer 66 such that the pawl 98 may be elastically deflected toward the exterior portion 18 to engage the recesses 99. In an alternative embodiment, the exterior portion 18 may contain a different number of recesses 99, for example, ranging between about two and ten, in order to permit more or less refined control of the angular position of the clip assembly 64 by the user.

In use, the user attaches the retractor carrying device 10 to his belt and tethers an object to the interior cavity 14 of the carrying case 12. To secure the object to the retractor carrying device 10, the user first moves the lid 13 into the open position (FIG. 2A) and extends the retractable tensile member 29 into an extended position outside of the interior cavity 14 by supplying a force sufficient to overcome the biasing force of the coil spring 69. The user then press-fits a wrist strap 61 connected to the object into the slit 51 provided on the end fitting 31. Next, the user releases the retractable tensile member 29 and permits the biasing force of the spring coil to retract the object into the interior cavity 14 of the carrying case 12. When the retractable tensile member 29 is in the fully retracted position, the end fitting 31 is fully nested in the recess formation 39, which permits the object to rest flush against the front surface 40 of the interior panel 19. The user then secures the object within the interior cavity 14 by moving the lid 13 into the closed position and wrapping the looped strap 15 that is attached to the lid 13 around the clasp 16 located on the exterior of the front wall 21 of the carrying case 12, as illustrated in FIG. 2B. The user may adjust the angular position of the carrying case 12 relative to the clip assembly 64 by ratcheting the clip assembly 64 into the desired position by supplying a sufficient force to deflect the pawl 98 backwardly and into the desired depression 99.

To deploy the object from the carrying case 12, the user unwraps the looped strap 15 from the clasp 16 and then rotates the lid 13 into the open position. The user then grasps the object stored in the interior cavity 14 of the carrying case 12 and removes the object from the interior cavity 14 by supplying a force sufficient to overcome the biasing force of the coil spring 69 and extend the retractable tensile member 29 into an extended position outside of the interior cavity 14. To return the object to a stored position in the interior cavity 14 of the carrying case 12, the user performs the aforementioned movements in reverse.

Figure 1B:
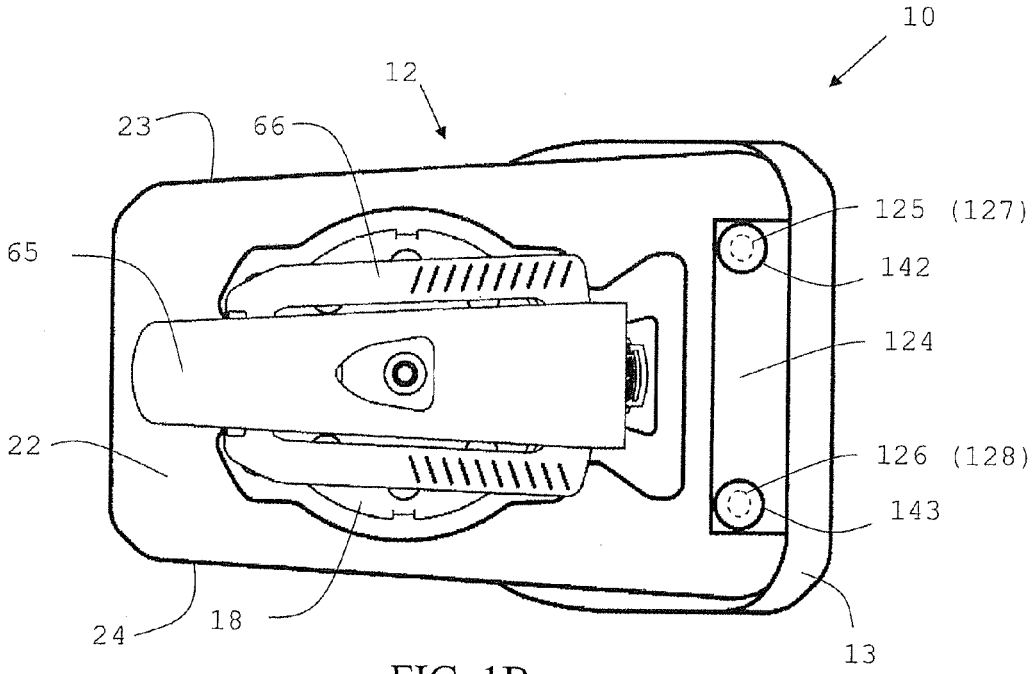
Figure 10A:
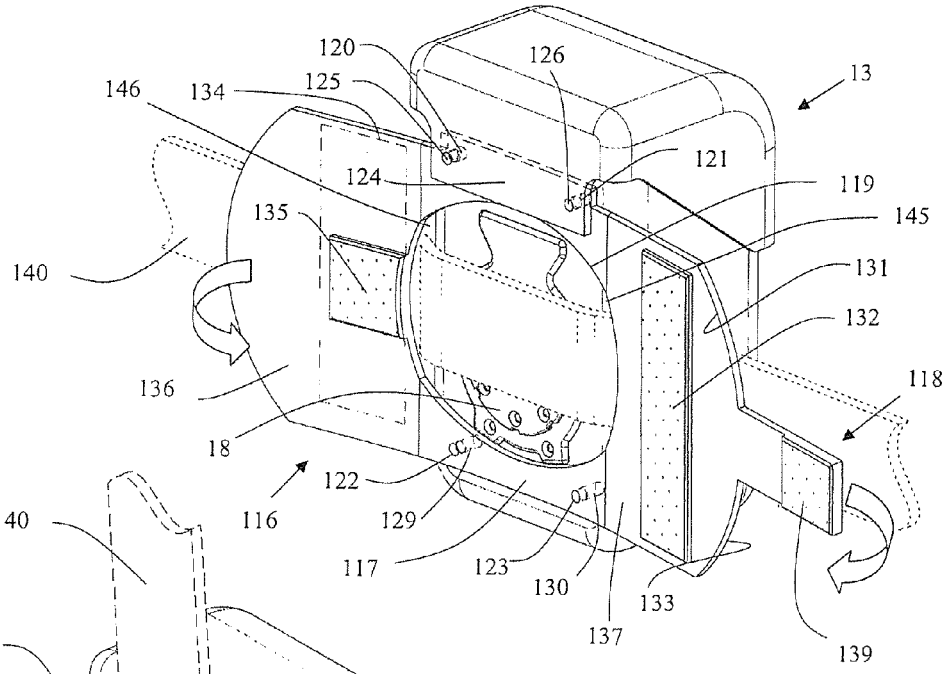
FIG. 10A is a rear perspective view of an embodiment of the retractor carrying case with a flexible clip shown in the open position.
Figure 10B:
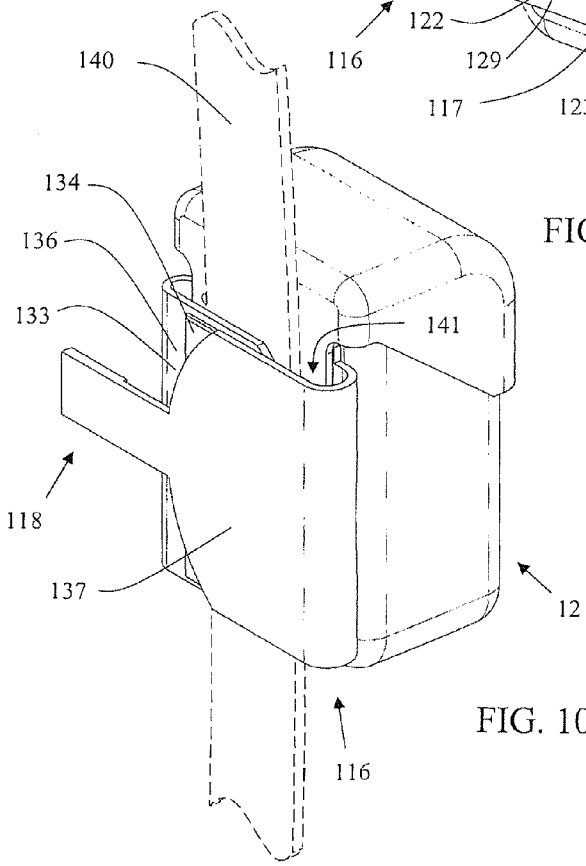
FIG. 10B is a rear perspective view of an embodiment of the retractor carrying case with the flexible clip shown in a closed position secured to a user's belt.

In an alternative embodiment shown in FIGS. 10A and 10B, the attachment assembly 63 includes a strap assembly 116 for securing the retractor carrying device 10 to the user's belt, strap, or waistband 140. The strap assembly 116 is formed from a relatively thin sheet having a front surface 133 and a back surface 131. The strap assembly 116 comprises a main portion 117, two flap members 136, 137 positioned in a lengthwise direction on opposing sides of the main portion 117, and a pull tab 118 extending from an outer edge of one of the flap members 137. The strap assembly 116 is moveable between an open position (FIG. 10A) and a closed position (FIG. 10B), and is securable in the closed position by any suitable means, such as a plurality of hook and loop fasteners described below. In one embodiment, the main portion 117 comprises an ovaloid opening 119 configured to expose the exterior portion 18, and is formed with a plurality of holes 120, 121, 122, and 123 (e.g., four) disposed around the periphery surrounding the ovaloid opening 119 for securing the strap assembly 116 to the carrying case 12. The ovaloid opening 119 is configured to prevent, or at least minimize, frictional contact between the exterior portion 18 and the strap assembly 116 which contact would otherwise prematurely wear the strap assembly 116. Additionally, as shown in FIG. 10A, a portion of the ovaloid opening 119 is configured to extend past the side walls 23, 24 of the carrying case 12 such that two gaps 145, 146 are formed between the strap assembly 116 and the carrying case 12, the significance of which will be described below. In one embodiment, the upper holes, 120 and 121, are aligned with the holes 125, 126 in the hinge portion 124 of the lid 13 and the holes 127, 128 (FIG. 1B) in the back wall 22 of the carrying case 12 which holes are provided for hingedly securing the lid 13 to the carrying case 12. In that embodiment, an upper end of the main portion 117 underlaps the hinge portion 124 and is secured by the same two fasteners 142 and 143 that hingedly connect the lid 13 to the carrying case 12, as shown in FIG. 1B. The lower holes 122, 123 in the main portion 117 are aligned with holes 129, 130 in the lower portion of the back wall 22 and are secured with two fasteners (not shown), such as button head rivets, extending through the holes 122, 129 and 123, 130, respectively. In an alternative embodiment, the strap assembly 116 may be attached to the carrying case 12 by other suitable means, such as sewing, bonding, adhering, buttons, or hook and loop fasteners. Moreover, while the strap assembly 116 and the lid 13 have been described with reference to two separate parts, in an alternative embodiment the strap assembly 116 and the lid 13 may be formed as a single integrated member.

The strap assembly 116 comprises a plurality of hook-and-loop type fasteners for securing the retractor carrying device 10 to the user's belt, strap, or waistband 140. As shown in FIG. 10A, a back surface 131 of one of the flaps 137 comprises a rectangular hook fastener 132 and a front surface 133 of the other flap 136 comprises a corresponding rectangular loop fastener 134 configured to engage the rectangular hook fastener 132. Additionally, a back surface 131 of the flap 136 comprises a square loop fastener 135 adjacent to the ovaloid opening 119. In an alternative embodiment, the shape, configuration, and quantity of the hook-and-loop fasteners may be modified without departing from the scope of the present invention in order to provide.

It is understood that the user's belt or strap 140 can be attached to the strap assembly 116 either in a lengthwise manner (FIG. 10A) or a crosswise manner (FIG. 10B). In the latter instance, the user wraps the flaps 136 and 137 around the user's belt 140 to form a cavity 141 through which the user's belt 140 extends and presses the rectangular hook fastener 132 onto the rectangular loop fastener 134 such that the hooks catch on the loops and form a detachable connection, as shown in FIG. 10B. In the illustrated embodiment, the lengthwise direction of the strap assembly 116 is substantially orthogonal to a lengthwise direction of the carrying case 12. In that embodiment, the flaps 136, 137 are folded into the closed position about axes substantially orthogonal to the lengthwise direction of the strap assembly 116. The flaps 136, 137 are configured such that the one flap 137 sufficiently overlaps the other flap 136 when the strap assembly 116 is in the closed position in order to permit the rectangular hook fastener 132 to engage the rectangular loop fastener 134. Additionally, the back surface 131 of the pull tab 118 comprises a square hook fastener 139 configured to engage the square loop fastener 135 on the back surface 131 of the flap 136. Specifically, when the strap assembly 116 is in the closed position (FIG. 10B) and secured to the user's belt or strap 140, the user may wrap the pull tab 118 around the flap 136 and up through the ovaloid opening 119 and then press the square hook fastener 139 onto the square loop fastener 134 in order to safely and conveniently secure the pull tab 118. Otherwise, an unsecured pull tab 118 may inadvertently catch on the user's clothing or another object and cause the strap assembly 116 to unexpectedly detach from the user's belt 140. To remove the retractor carrying device 10 from the user's belt 140, the user supplies a force sufficient to separate the loop fastener 134 and the hook fastener 132, such as by pulling the pull tab 118.

In the former instance, where the user's belt or strap 140 can be attached to the strap assembly 116 in a lengthwise manner (FIG. 10A), the user slides the belt 140 into the ovaloid opening 119 through the first gap 145, extends the belt 140 in a lengthwise direction over the exterior portion 18, and then slides the belt 140 out of the ovaloid opening 119 through the second gap 146. In the disclosed embodiment, the strap assembly 116 may remain in either the open position or the closed position, as described above. In one embodiment, the lower portion of the main portion 117 of the strap assembly 116 may be releasably attached to the carrying case 12, for example, with buttons or hook and loop fasteners, such that the lower portion of the main portion 117 may be disconnected from the carrying case 12 to permit the user to attach the retractor carrying device 10 to the user's belt 140. In the disclosed embodiment, the user may releasably detach the lower portion of the main portion 117 from the carrying case 12 and then slide the retractor carrying device 10 down over the user's belt 140 in between the strap assembly 116 and the back wall 22 of the carrying case 12. The user may then re-secure the lower portion of the main portion 117 to the back wall 22 of the carrying case 12.

The strap assembly 116 may be formed from any suitably flexible and durable material, such as nylon, leather, or woven cotton. The hook-and-loop fasteners may be made from any suitable material, such as nylon and/or polyester, and may be attached to the strap assembly 116 by any means well known in the art, such as sewing, bonding, or adhering. In an alternative embodiment, the hook-and-loop fasteners may be replaced or supplemented by other fastening means, such as buttons, zippers, laces, buckles, and/or clasps. Additionally, in an alternative embodiment, the strap assembly 116 may be oriented at a different angle relative to the carrying case 12, for example, parallel with the lengthwise direction of the carrying case 12 or angled at a 45-degree angle relative to the lengthwise direction of the carrying case 12.

While this invention has been described in detail with particular references to exemplary embodiments thereof, it is understood by those skilled in the art that variations, additions, and deletions are contemplated within the scope of this invention. The exemplary embodiments described herein are not intended to be exhaustive or to limit the scope of the invention to the exact forms disclosed. Moreover, the drawings are not necessarily to scale.

What is claimed is:

1. A retractor device for carrying a portable object, the retractor device comprising:

a carrying case comprising a front wall and a back wall, the front and back walls together defining an interior cavity and a first opening for receiving the portable object into the interior cavity, the back wall defining a second opening;

an integrated retractor assembly mounted to the back wall of the carrying case, wherein the integrated retractor assembly comprises:

an interior panel mounted on an interior surface of the back wall of the carrying case and housed in the interior cavity of the carrying case;

an exterior panel mounted on an exterior surface of the back wall of the carrying case and joined to the interior panel through the second opening of the carrying case; and a retractable reel mechanism coupled to at least one of the interior panel and the exterior panel, wherein the retractable reel mechanism is housed between the interior panel and the exterior panel; and an attachment assembly mounted to the carrying case.

2. The retractor device of claim 1, wherein the interior panel comprises polycarbonite plastic.

3. The retractor device of claim 1, wherein the retractable reel mechanism comprises:

a reel rotatably connected to the interior panel;

a retractable tensile member having a proximal end and a distal end opposite the proximal end, the proximal end attached to the reel, and wherein the retractable tensile member is moveable between a retracted position and an extended position; and an end fitting connected to the distal end of the retractable tensile member.

4. The retractor device of claim 3, further comprising a circular flange on the interior panel, wherein the retractable tensile member is rotatably disposed within the circular flange.

5. The retractor device of claim 3, further comprising a recess formation defined in the interior panel, and wherein the end fitting is adapted to be nested and tucked away in the recess formation when the retractable tensile member is in the retracted position.

6. The retractor device of claim 3, wherein the end fitting defines a slit configured to receive a wrist strap with a press fit connection.

7. The retractor device of claim 1, wherein the carrying case comprises thermoformed closed cell polyethylene foam.

8. The retractor device of claim 1, further comprising a nylon lining bonded to an exterior surface of the carrying case.

9. The retractor device of claim 1, wherein the attachment assembly comprises a clip assembly ratchedly connected to the integrated retractor assembly for attaching the retractor device to a user's belt or strap.

10. The retractor device of claim 1, wherein the attachment assembly comprises a strap assembly connected to the carrying case for attaching the retractor device to a user's belt or strap.

11. The retractor device of claim 1, further comprising a lid hingedly connected to the carrying case, wherein the lid is moveable between an open position and a closed position.

12. The retractor device of claim 11, further comprising:

a looped strap connected to the lid; and a clasp connected to an exterior surface of the front wall of the carrying case, wherein the lid is secured in the closed position by wrapping the looped strap around the clasp.

13. A retractor device for carrying a portable device, the retractor device comprising:

a carrying case comprising a front wall and a back wall, the front and back walls together defining an interior cavity and a first opening for receiving the portable object into the interior cavity, the back wall defining a second opening;

a retractor assembly mounted to the back wall of the carrying case, the retractor assembly comprising:

an interior panel in the interior cavity of the carrying case;

a retractable reel mechanism coupled to the interior panel;

a recess defined in the interior panel;

a retractable tensile member having a proximal end and a distal end opposite the proximal end, wherein the retractable tensile member is moveable between a retracted position and an extended position, wherein the tensile member in the extended position extends out of the first opening in the carrying case; and an end fitting connected to the distal end of the retractable tensile member, wherein the end fitting is fully recessed in the recess when the retractable tensile member is in the retracted position.

14. The retractor device of claim 13, wherein the recess in the inner panel tapers between a wider end and a narrower end.

15. The retractor device of claim 13, further comprising an attachment assembly coupled to the back wall of the carrying case, the attachment assembly configured to facilitate attachment of the retractor device to a user.

16. The retractor device of claim 15, wherein the attachment assembly comprises a strap assembly connected to the carrying case.

17. The retractor device of claim 15, wherein the attachment assembly comprises a clip assembly ratchedly connected to the integrated retractor assembly.

18. The retractor device of claim 13, wherein the end fitting is cylindrical and defines a semi-circumferential slit configured to receive a wrist strap.

19. The retractor device of claim 13, further comprising a lid hingedly coupled to the back wall of the carrying case, the lid configured to move between a closed position in which the first opening in the carrying case is covered and an open position in which the first opening in the carrying case is uncovered.

20. The retractor device of claim 13, further comprising an exterior panel mounted on an exterior surface of the back wall of the carrying case and joined to the interior panel through the second opening of the carrying case, wherein the retractable reel mechanism is housed between the interior panel and the exterior panel.

* * * * *